United States Patent [19]

Mansour

[11] Patent Number: 4,492,041

[45] Date of Patent: Jan. 8, 1985

[54] CURING CHAMBER WITH CONSTANT GAS FLOW ENVIRONMENT AND METHOD

[75] Inventor: Maher L. Mansour, Columbus, Ohio

[73] Assignee: Ashland Oil, Inc., Ashland, Ky.

[21] Appl. No.: 516,978

[22] Filed: Jul. 25, 1983

[51] Int. Cl.[3] ..... F26B 5/04; F26B 3/00; F26B 25/00

[52] U.S. Cl. ..... 34/15; 34/34; 34/36; 34/37; 34/242

[58] Field of Search ..... 34/15, 34, 36, 37, 242

[56] References Cited

U.S. PATENT DOCUMENTS

| | | | |
|---|---|---|---|
| 3,822,226 | 7/1974 | Taft et al. | 427/255.6 |
| 3,977,091 | 8/1976 | Hortig et al. | 34/34 |
| 4,150,454 | 4/1979 | Rothchild | 34/28 |
| 4,223,450 | 9/1980 | Rothchild | 34/34 |

*Primary Examiner*—John J. Camby
*Attorney, Agent, or Firm*—Mueller and Smith

[57] ABSTRACT

Disclosed is a chamber which defines a constant gas environment for passing moving objects therethrough and which is in open communication with the outside. The chamber comprises an inlet zone, a central interior gas flow zone wherein the constant gas environment is maintained, and an outlet zone. All zones are in open communication and the inlet and outlet zones are in open communication with the environment outside of the chamber. The interior gas flow zone has ostensibly transverse laminar gas flow passing through it. The inlet and outlet zones are provided with a source of suction to create a pressure within each zone which is less than the ambient pressure outside of the chamber and wherein such pressures are substantially the same. The interface between the central flow zone and each of the inlet and outlet zones are held under conditions substantially preclusive of turbulent flow conditions. The chamber is ideally designed to cure vapor permeation curable coating compositions, although a variety of other applications exist for the chamber.

13 Claims, 7 Drawing Figures

CURING CHAMBER WITH CONSTANT GAS FLOW ENVIRONMENT AND METHOD

BACKGROUND OF THE INVENTION

The present invention relates to vapor permeation curable coating compositions and more particularly to a curing chamber with constant gas chamber environment which is designed especially to cure said coating compositions.

Vapor permeation curable coatings are a class of coatings formulated from aromatic-hydroxyl functional polymers and multi-isocyanate cross-linking agents wherein an applied film thereof is cured by exposure to a vaporous tertiary amine catalyst. In order to contain and handle the vaporous tertiary amine catalyst economically and safely, curing chambers have been developed. Generally, such curing chambers are substantially empty, rectangular boxes through which a conveyor bearing the coated substrate passes. Provision is made for entrance and exit of vaporous tertiary amine, normally borne by an inert gas carrier such as nitrogen or carbon dioxide, for example, and means are provided at the inlet and outlet of the chamber to enhance containment of the vaporous tertiary amine catalyst within the chamber. The inlet and outlet containment means further restrict the entrance of oxygen into the chamber because oxygen can create an explosive condition with the vaporous tertiary amine catalyst. Cure of such coatings is so rapid that no external source of heat is required.

Representative examples of past curing chambers are set forth in U.S. Pat. Nos. 3,851,402, 3,931,684, and 4,294,021. Of particular note in the patented curing chambers is the provision made at the inlet and outlet for containment of the vaporous tertiary amine curing gas within the chamber. For example, U.S. Pat. Nos. 3,851,402 and 3,931,684 provide moist air curtains at the inlet and outlet which moist air curtains along with a source of suction are designed to minimize escape of tertiary amine gas from within the chamber. Somewhat different is the design in U.S. Pat. No. 4,294,021 which calls for the exhaust fan to create a slight negative pressure to induce gas flow within the chamber in the direction of the exhaust duct which is located near the exit of the chamber. It is noted by the patentees that air is dragged by the conveyor from the inlet and such flow of air along with the vaporous amine circulates from the entrance of the chamber to the exhaust duct where the gas is withdrawn for recirculation. The patentees further note that the negative pressure created at the exhaust duct near the outlet also creates a flow of air from the exhaust end of the chamber into the chamber itself. No provision in this patent is seen for minimizing air flow into the chamber and, to the contrary, the design appears to encourage the flow of air into the chamber.

While prior curing chambers certainly have performed adequately in the marketplace, many problems exist with prior designs. One problem with prior designs is the loss of amine vapor. Another problem is the inability to prevent air from entering into the curing portion of the chamber. A disadvantage is the inability to handle large objects, eg. automobile parts. The present invention addresses such deficiencies in the prior art and provides a unique chamber as will be more fully appreciated by the description contained below.

Broad Statement of the Invention

The present invention is a chamber which defines a constant gas chamber environment and which accommodates moving objects to pass therethrough. The entire chamber is in open communication with the environment outside of the chamber. Such chamber comprises a housing which confines an inlet zone, an interior central gas zone, and an outlet zone. Each of the zones is in open communication and the inlet and outlet zones are in open communication with the environment outside of the chamber. The inlet and outlet zones are connected to a source of suction which creates a pressure within each said zone which is less than the ambient pressure outside of the chamber. The sources of suction also are adjusted and maintained such that the pressures within each said outlet and inlet zones are substantially the same. Also, it is desirable to adjust and maintain the sources of suction so that the velocity of gas, eg. air, in both the inlet and outlet zones are in the substantially laminar flow regime.

The interior gas zone has a gas flow inlet means and an oppositely disposed gas flow outlet means. Such interior gas flow zone further has flow control means which are maintained to establish ostensibly transverse laminar gas flow between said inlet and said oppositely disposed outlet means. The interface between the interior gas zone and each of said inlet and outlet zones are held under conditions substantially preclusive of turbulent flow conditions and desirably the relative gas flow velocity at the interface is at a minimum.

Advantages of the present invention include a chamber which is relatively inexpensive to construct, yet which operates with extreme efficiency. Another advantage is the simplicity with which the interior gas zone conditions are maintained substantially constant. That is, there is little loss of any amine gas from the interior gas flow zone. Yet another advantage is the ability of the novel chamber to accommodate very large objects to be passed therethrough. These and other objects will be readily apparent to those skilled in the art based upon the disclosure contained herein.

The drawings will be described in detail in connection with the description of the invention which follows.

DETAILED DESCRIPTION OF THE INVENTION

The fundamental concepts underlying the success of the design of the curing chamber of the present invention are the pressure balance maintained between the inlet and outlet zones and the minimization of relative transverse gase velocity between the gas flows at the boundaries of the interior gas zone and the inlet and outlet zones. As the description of the invention unfolds, it will be readily apparent that the gas flow in the central zone is confined within the interior of the curing chamber by maintaining the pressure within the outlet and inlet zones to be substantially equal. Along with pressures in each of said zones being slightly less than the ambient atmospheric pressure outside of the curing chamber, no net flow from within the central zone to the outside environment can occur. Once the pressures in the inlet and outlet zones are stabilized, there will be a slight flow of exterior atmosphere (eg. air) from the outside into the inlet and outlet zones. This condition, while suppressing escape of gas from the central gas zone, will not prevent loss of such gas flow from the central zone to the source of exhaust in the outlet zone and the inlet zone. In order to minimize loss of gas flow from the central gas zone, so that such gas can be conveniently recycled for economy and efficiency, the relative velocity of gas flow in the central gas zone at the boundary of such zone and the inlet zone and the outlet zone should be minimized, and desirably such flows should be identical in velocity and direction. The foregoing underlying keys fundamental for successive practice of the present invention will be further elaborated upon in the description below.

Figure 1:
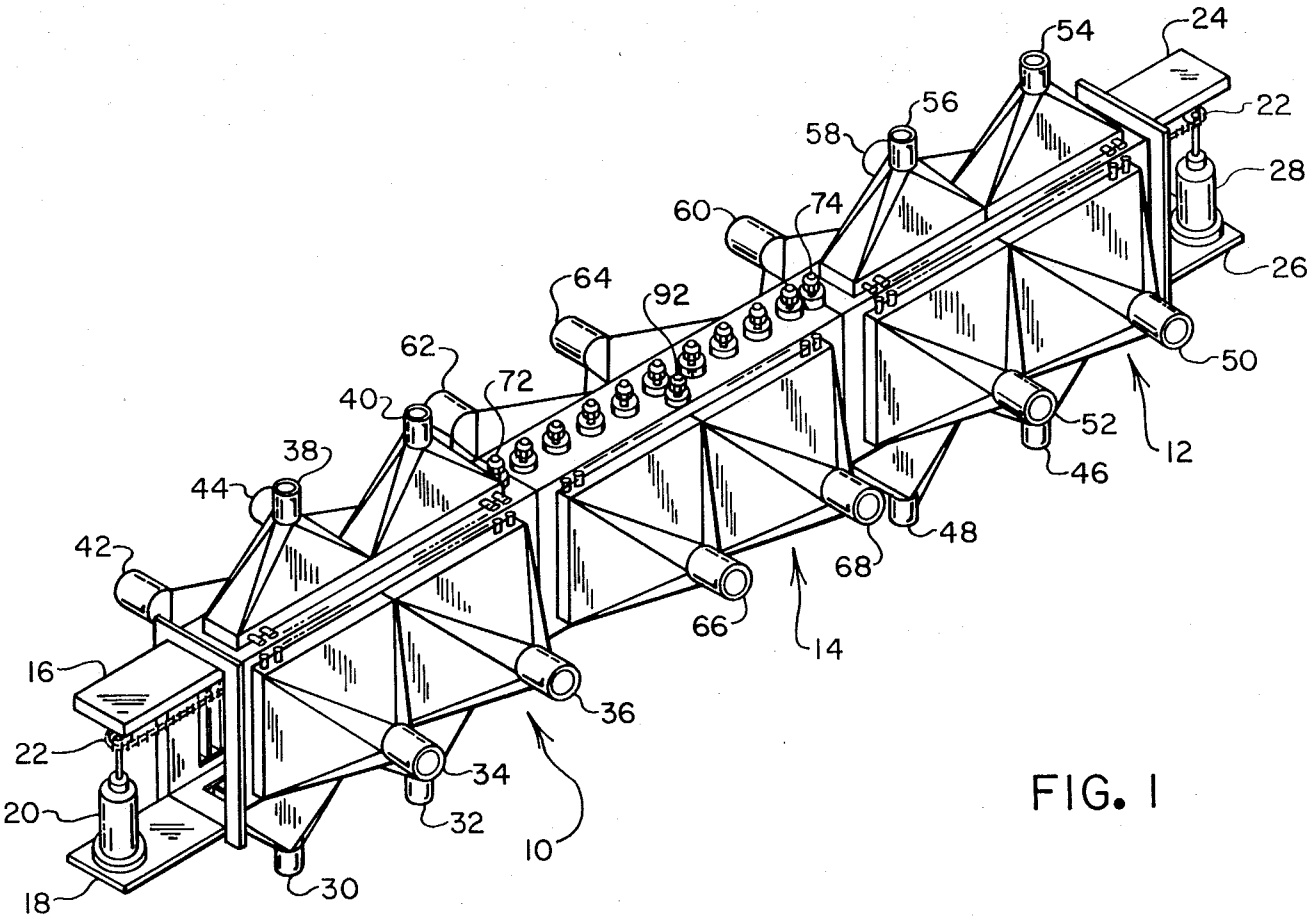
FIG. 1 is a perspective view of a prototype curing chamber of the present invention fitted with an overhead conveyor.

Referring to FIG. 1, the chamber can be seen to be composed of an inlet zone or section identified generally as 10, an outlet zone generally identified as 12, and a central interior gas zone interposed between inlet zone 10 and outlet zone 12 and generally identified as 14. The curing chamber depicted in the drawings is of a prototype scale chamber especially designed for flexibility so that all aspects of operation of the chamber can be implemented for a full understanding of the invention. Thus, many of the features of the described chamber eventually may prove impractical or unnecessary for inclusion in a plant scale chamber. Of course, plant design, intended use of the chamber and like factors will be important in dictating the desirable combination of features to include on the plant scale chamber. The chamber in FIG. 1 is seen fitted with an overhead conveyor support 16 and base platform 18 upon which sits drive shaft assembly 20 for driving overhead conveyor 22. A motor and variable speed control assembly are affixed to drive assembly 20 below platform 18 and are not shown in the drawing. Outlet zone 12 similarly is fitted with overhead conveyor support 24, base platform 26, and follower sprocket assembly 28. It will be fully appreciated that the choice of designating zone 10 as an inlet zone and zone 12 as an outlet zone is arbitrary since the unit is capable of operating with zone 12 being defined as the inlet zone and zone 10 being defined as the outlet zone. The definition of inlet and outlet zones for present purposes follows the entrance of parts into the chamber as the inlet zone and the exit of the parts defining the outlet zone. Of course it will be appreciated that the design depicted in FIG. 1 permits parts to enter the chamber from either end and to return to such entry end because overhead conveyor 22 is a closed loop system. This design permits parts to make a single pass or a double pass through central zone 14 as is necessary, desirable, or convenient.

Inlet zone 10 is fitted with exhaust hoods 30–44 and outlet zone 12 is fitted with exhaust hoods 46–60. Said hoods are connected to a source of suction, suitably provided by conventional exhaust ventilation equipment. While each of said hoods can be individually controlled as to the amount of gas which it can exhaust, it will be appreciated that usually equal gas flow through each hood will be desired. Of course, the number of hoods implemented in the prototype chamber depicted in the drawings provides ultimate flexibility in design and enables full evaluation of all aspects of the chamber. In plant scale up of such chamber, the number of hoods and location of the hoods may not precisely parallel the design in the depicted prototype scale model; however, operation of the chamber in all relevant functional aspects will follow the underlying precepts disclosed herein. Central interior gas zone 14 is fitted with inlet gas flow hoods 62 and 64 and outlet gas hoods 66 and 68. Gas flow containing a curing gas (eg. a tertiary amine for vapor permeation curing) will be flowed into central gas flow zone 14 through inlets 62 and 64 and will be withdrawn therefrom through vents 66 and 68 which desirably are piped for return by recycle to inlets 62 and 64.

A series of flow control vanes are housed within all sections of the chamber. Also, provision for sampling flow rates and gas concentrations also is fitted on the chamber. These and other features of the chamber will be more fully set forth and described in connection with the other drawing figures.

Figure 2:
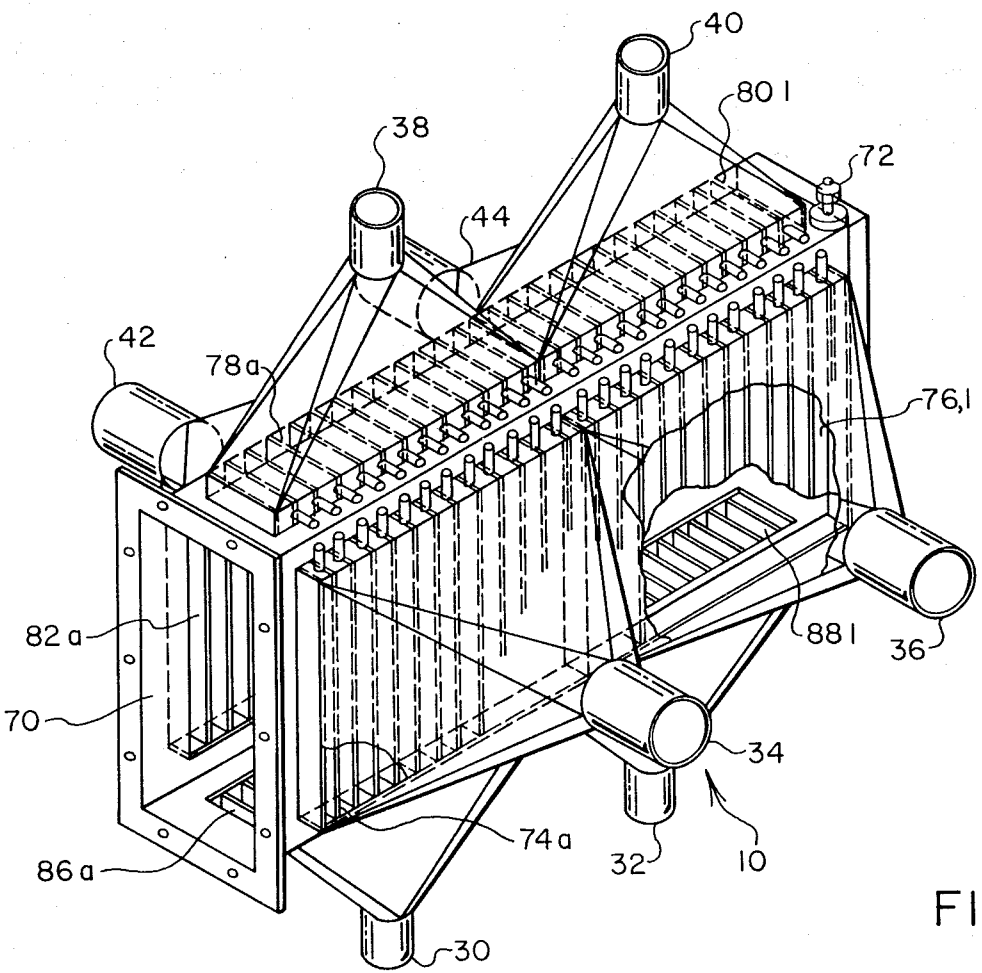
FIG. 2 is an enlarged perspective view of one side of the inlet zone of the curing chamber with a portion thereof broken away to show its interior construction.
Figure 3:
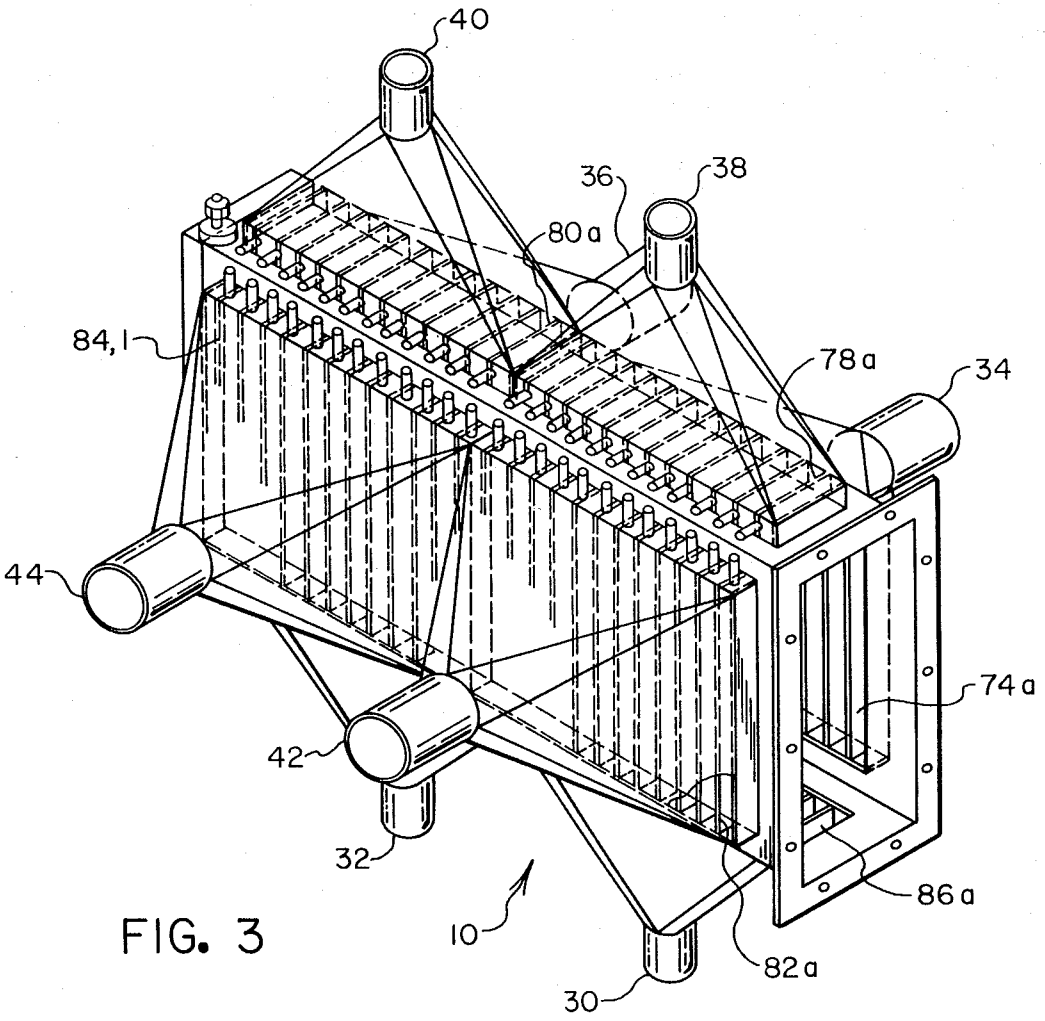
FIG. 3 is an enlarged perspective view of the reverse side of the inlet zone of FIG. 2.
Figure 4:
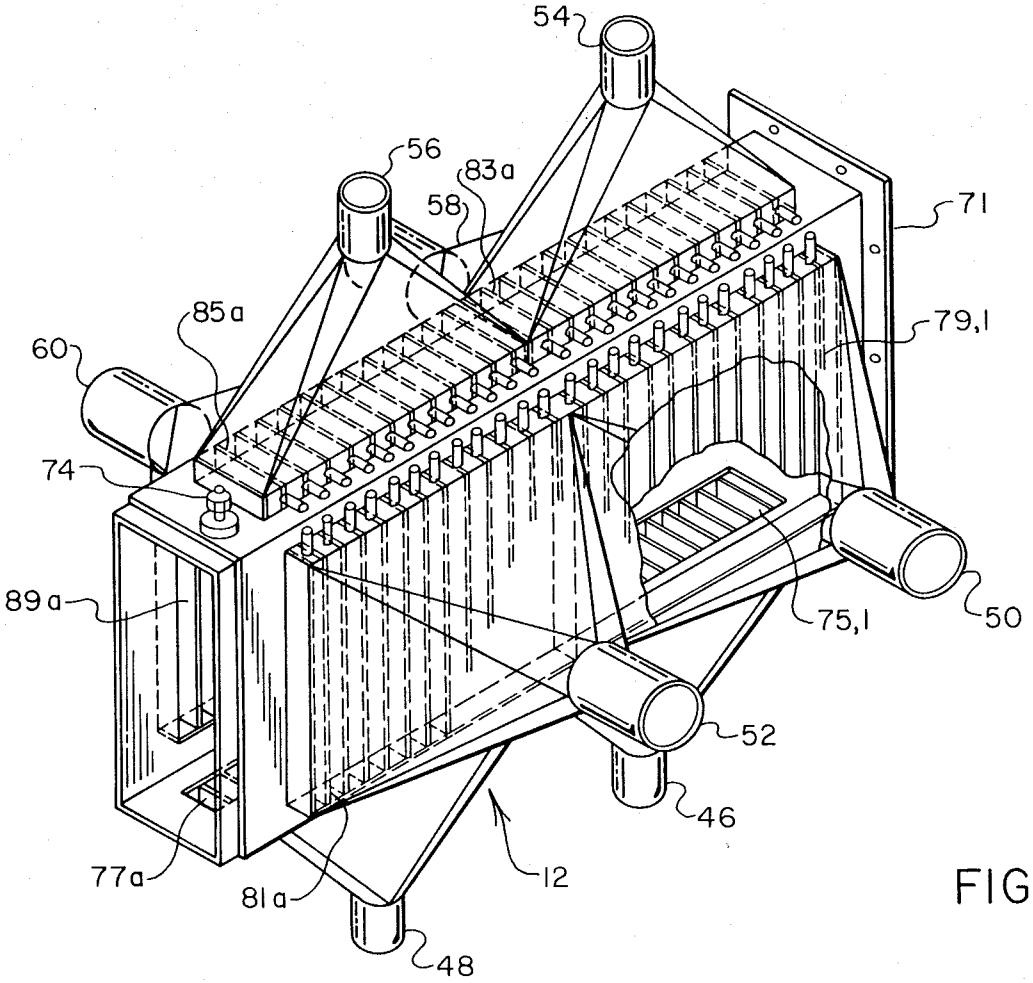
FIG. 4 is an enlarged perspective view of one side of the outlet zone of the curing chamber with a portion thereof broken away to show its interior construction.
Figure 5:
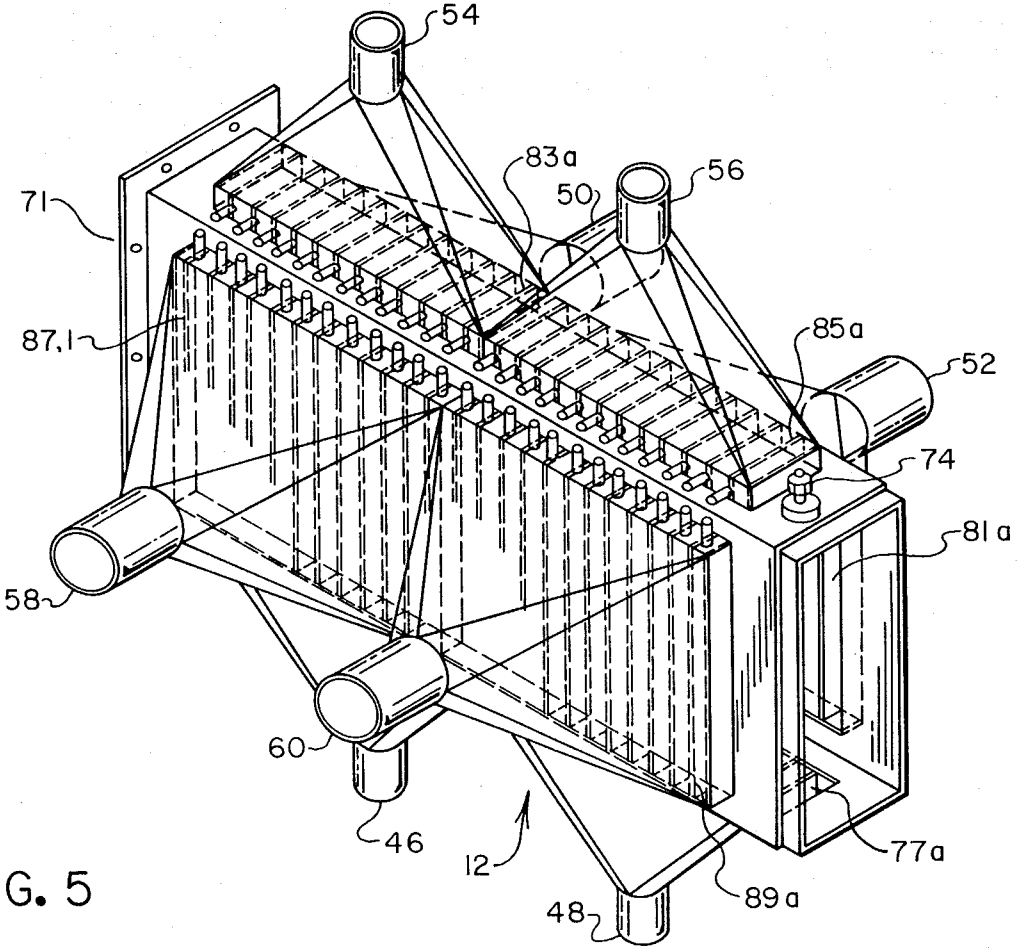
FIG. 5 is an enlarged perspective view of the reverse side of the outlet zone of FIG. 4.

Referring to FIGS. 2 and 3, the design of the prototype curing chamber calls for inlet section 10 and outlet section 12 to be identical in construction; thus, the description given for inlet zone 10 in FIGS. 2 and 3 will be accurate for outlet zone 12 in FIGS. 4 and 5. Zone 10 has inlet 70 which has inside dimensions of 12.7 cm (5 inches) width by 30.48 cm (12 inches) height. Drive assembly 20 with platforms 16 and 18 are attached to entrance 70, but are not shown in FIG. 2. The entire interior of zone 10 is empty (but for the conveyor) and the interior of zone 10 is in open communication through entrance 70 with the environment outside of the chamber. Zone 10 is fitted with sampling port 72 in the roof of zone 10 adjacent the boundary of zone 10 with central gas zone 14. Similarly, outlet zone 12 is fitted with sampling port 74 (see FIG. 1) which is similarly located in juxtaposition with the boundary between central zone 14 and outlet zone 12. Further detail on the sampling port will be given in connection with the description of central gas zone 14 which follows below. Each exhaust hood 30–44 of inlet zone 10 is fitted with an array of 12 vanes as represented by vane 74*a* of hood 34 depicted in the cut-away section in FIG. 2. For hood 34 the chamber contains vanes 74*a*–74*l*; hood 36 contains vanes 76*a*–76*l*; hood 38 contains vanes 78*a*–78*l*; hood 40 contains vanes 80*a*–80*l*; hood 42 contains vanes 82*a*–86*l*; hood 44 contains vanes 84*a*–84*l*; hood 30 contains vanes 86*a*–86*l*; and hood 32 contains vanes 88*a*–88*l*. Not all of the vanes are fully shown and labeled in the drawing in order for a better understanding thereof.

Each of said vanes measures 2.54 cm (1 inch) in width by 30.48 cm (12 inches) in height and is 0.635 cm ($\frac{1}{4}$ inch) thick. Each of the vanes is independently adjustable by a locking Allen nut located at the top of each vane outside of the chamber. By loosening the Allen nuts with an Allen wrench, each vane in the chamber can be independently and individually adjusted. The vane adjustment determines the amount of gas flow entering each hood and can additionally provide direction to such flow. The vanes, then, essentially function as a gas distributor for equalizing the gas flow entering each zone while having the ability to additionally effect direction of the gas flow entering each zone. Various designs of gas distribution means are known in the art and can be envisioned for use in the chamber of the present invention.

The hoods of inlet zone 10 and outlet zone 12 are connected to a source of exhaust means, such as a fan or the like. Alternatively, the exhaust could be piped to a scrubber for scrubbing residual traces of amine vapors contained in such withdrawn flows. Conventionally, sulfuric acid or phosphoric acid typically are used for scrubbing vaporous amine from such exhaust flows. It can be appreciated that various other types of scrubbing facilities may be required depending upon the nature and composition of vapor being handled and flowed through central zone 14. In fact, should the chamber merely be operating to contain a source of heated gas through central zone 14, it is conceivable that no scrubbing facilities may be required for the exhaust flows from zones 10 and 12. Further, the number of hoods shown in the drawings is not critical for proper functioning of the chamber in accordance with its intended design, but are in number and placement adequate to provide full flexibility of operating and evaluating the prototype chamber set forth in the drawings. Thus, it is entirely conceivable that a single hood could properly be utilized for the entrance and exit zones or that multiple hoods stacked vertically and/or laid horizontally may be appropriate. A decided benefit of the design of the chamber of the present invention is its total flexibility and adaptability to change to particular needs and space requirements without deleteriously affecting the advantages achieved by the unique design of such chamber. Accordingly, provision for overhead and underneath hoods additionally may not be required depending upon the requirements of the chamber and space limitations in the plant. Operation of the chamber in such different modes will find adequate experimental support in the examples which follow.

Identical in operation to inlet zone 10 in the prototype unit is outlet zone 12. The various parts of the outlet zone will be only briefly described. Details of their function are provided with reference to their corresponding parts in the description of inlet zone 10. Referring to FIGS. 4 and 5, outlet zone 12 is fitted with hood 46 containing vanes 75*a*–75*l*; hood 48 containing vanes 77*a*–77*l*; hood 50 containing vanes 79*a*–79*l*; hood 52 containing vanes 81*a*–81*l*; hood 54 containing vanes 83*a*–83*l*; hood 56 containing vanes 85*a*–85*l*; hood 58 containing hoods 87*a*–87*l*; and hood 60 containing vanes 89*a*–89*l*. The vanes are adjustable in the manner of the vanes in the hoods of inlet zone 10. Cured parts can be removed from outlet zone 12 through opening 71.

Figure 6:
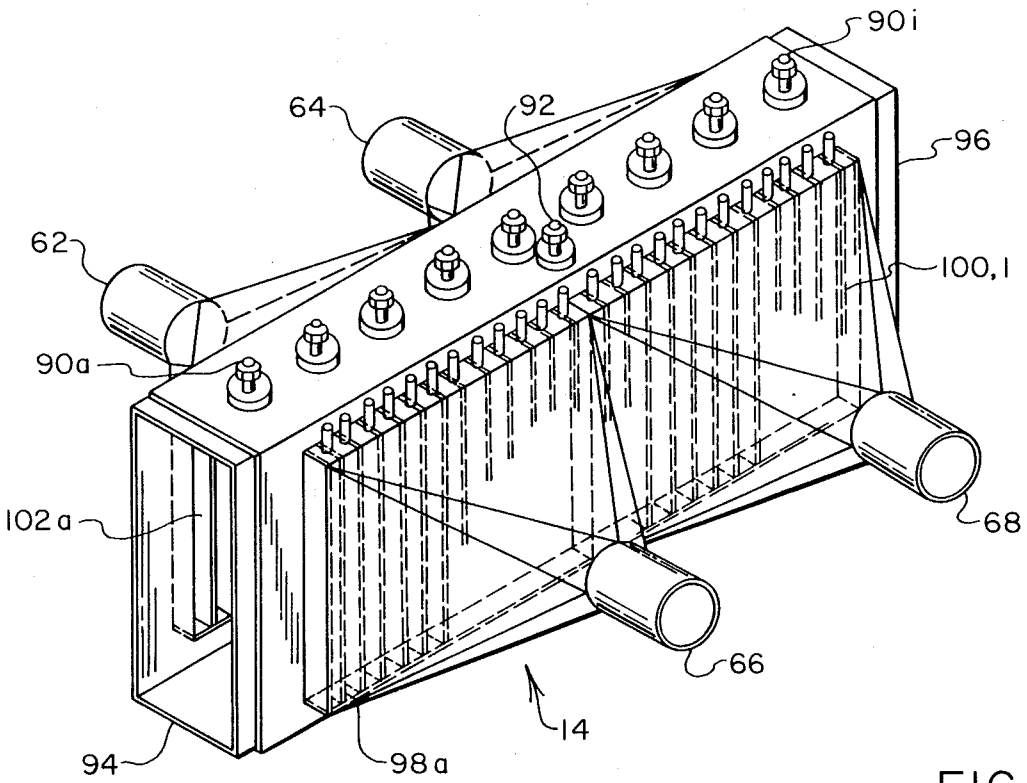
FIG. 6 is an enlarged perspective view of one side of interior central gas flow zone of the curing chamber.
Figure 7:
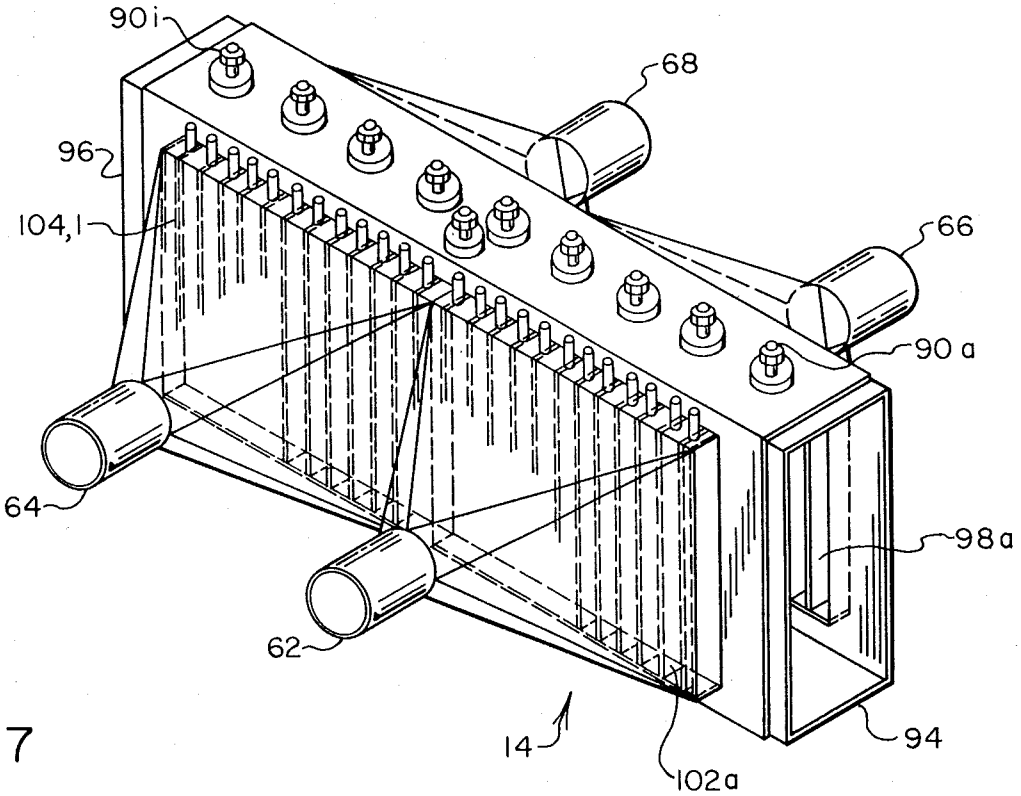
FIG. 7 is an enlarged perspective view of the reverse side of the central gas flow zone of FIG. 6.

Referring to FIGS. 6 and 7, central zone 14 contains inlet hoods 62 and 64 and outlet or exhaust hoods 66 and 68. Exhaust hoods 66 and 68 desirably can be connected to a source of suction, eg. a fan or the like, and piped for recycle to inlet hoods 62 and 64. Conservation of ingredients and/or energy is achieved by such recycle. Additionally, make up vaporous amine or other ingredient can be accommodated as the examples will demonstrate. Inlet hood 62 contains vanes 102*a*–102*l*; hood 64 contains vanes 104*a*–104*l*; exhaust hood 66 contains vanes 98*a*–98*l*; and exhaust hood 68 contains vanes 100*a*–100*l*. These vanes are identical in dimension and maneuverability as described for zones 10 and 12. Of importance in central gas zone 14 is the ability of such vanes or gas distribution means to direct the flow of inlet gas from hoods 62 and 64 in a laminar transverse flow regime. Additionally, the gas distribution or flow control means for the exhaust hoods additionally can enhance the desired transverse gas flow. The number of inlet and exhaust hoods for central chamber 14 as well as the number and design of the vanes is a matter of engineering gas design which can vary without departing from the design and functionality of the chamber of the present invention. Central zone 14 additionally is fitted with sampling ports 90*a*–90*i* and 92. These sampling ports permit measurement of concentrations of vaporous ingredients flowing through central zone 14 and the velocity of gas flowing through such zone. The location and number of sampling ports are not critical for successful operation of the chamber and can be provided in location and quantity for commercial implementation of the chamber as is necessary, desirable, or convenient for control of the intended gas flow through central zone 14.

Central zone 14 is in open communication with inlet zone 10 at opening 94 and with exit or outlet zone 12 at opening 96. It will be appreciated that the length and number of central zones can be altered for achieving special effects and/or the intended result of the chamber. The use of a single zone in FIGS. 6 and 7 and for the prototype chamber merely is for convenience and experimental operation of the chamber. Since transverse laminar flow through central zone 14 is desired, no provision is made for inlet or exhaust openings in the contrary direction. It must be appreciated, however, that the chamber can be designed for operation of the gas flow through central zone 14 to take place in the vertical direction either entering from the top or from the bottom of such zone. So long as transverse gas flow in one direction is maintained, the particular direction of such gas flow can be defined based upon other criteria, such as, for example, space requirements, particular ingredient passing through central zone 14, residence time of objects passing through central zone 14, and like factors. Central zone 14 additionally contains no members which would undesirably contribute towards unnecessary turbulence being created within the zone.

In this regard and because it is highly desirable to maintain minimum relative gas velocities at the boundaries between central zone 14 and zones 10 and 12, it is desirable to provide direction to the gas flows in zones 10 and 12 and speed control of such flows to match the direction and speed of flow through central zone 14. By controlling the direction and speed of gas flow at the inner boundary of zones 10 and 12, the relative velocity between such boundary flows within and adjacent central zone 14 will be at a minimum, resulting in minimum losses of vaporous amine or other agent (such as heat) from central zone 14. One method for easily accomplishing such flow regime will be described in particularity for inlet zone 10, but such method obtains equally for outlet zone 12. For inlet zone 10, hood 42 can be closed and hood 44 can be opened to the ambient atmosphere surrounding the chamber. Additionally, it would be desirable to close underneath hoods 30 and 32 and overhead hoods 38 and 40. Hood 34 and hood 36 will be retained in their connection to a source of suction. With suction applied to hoods 34 and 36, ambient atmosphere, eg. air, will flow into zone 10 through opening 70 and through the opening for hood 44. Since a source of exhaust is disposed oppositely to hood 44, eg. hood 36, air entering hood 44 will flow transversely through zone 10 to be exhausted through hood 36. Note that this transverse gas flow is cocurrent and parallel with the gas flow in zone 14 via inlet 62 and outlet 66. The velocity of gas or air flowing transversely through zone 10, in part, can be controlled by adjusting vanes 84*a–l* and/or vanes 76*a–l*.

When the velocity of gas flowing transverse in zone 10 at the boundary with central zone 14 is substantially equal to the gas flow velocity in zone 14 created from inlet 62 through outlet 66, there will be substantially no gross diffusion by eddy diffusions or the like therebetween, thus minimizing losses of vaporous amine or other agent from central zone 14. It is believed that a minor amount of molecular diffusion which will occur is slight and can be ignored for present purposes. It will be appreciated, as noted above, that the same parallel cocurrent flow regime will be established from inlet 60 to outlet 52 for zone 12. The examples further will illustrate and support this embodiment of the present invention. Note also that inlets 62 and 64 could be connected to a source of carrier or inert gas rather than to air as a carrier gas. In fact, the transverse flow regime in zones 10 and 12 could be utilized throughout the entire length of each zone. Using the carrier or inert gas alternative, air would enter the chamber only through openings 70 and 71 and its concentration would diminish rapidly to provide an ostensibly carrier or inert gas environment in zone 14.

As noted above, turbulence in the curing chamber is to be avoided and essentially laminar flow should be maintained throughout the length of chamber. One surprising result uncovered during operation of the chamber illustrated in the drawings was the gas flow velocity entering inlet 70 of zone 10 or inlet 71 of zone 12. Since vaporous amine containment was the initial object of the invention, it first appeared proper to maintain relatively high velocities of air entering the inlet and outlet zones. Unexpectedly, it was discovered that a gas flow velocity of about 7.6 meters/min. (25 feet/-min.) was more than adequate for containment of the vaporous amine, provided that the pressure balance within zones 10 and 12 was maintained. Such low velocity rates are important in minimizing turbulence within the chamber.

It will be appreciated that the design of inlet zone 10 and outlet zone 12 provide for identical designs. This identity in design means that the sources of suction provided by the hoods can be used as an indicia correlative to the pressure contained within each zone. That is, a measure of the pressure in such zones, because of their identical construction, can be by the mass of gas entering each said zone from the outside, which mass, in turn, can be monitored by determining the velocity of air entering each of said zone. Such mass or velocity measurements, thus, are a convenient indicia to use for determining the pressures maintained within zones 10 and 12 per the construction shown of the chamber in the drawings. It must be realized that space limitations in existing plants often may dictate that identical construction of the inlet zone and the outlet zone is not feasible. Under such conditions, the pressures within each of said zones still must be maintained to be substantially the same in order to ensure that no escape of gas from the central gas zone occurs. With different construction and configuration of the inlet zone and the outlet zone, such pressure still can be maintained substantially constant, though the mass of air entering each said zone and the relative velocity of such gases necessarily would be different. So long as the remaining necessary conditions of the chamber are maintained, successful practice of the invention still follows according to the disclosure contained herein.

It will be appreciated that the nature of gas environment through the central gas zone merely can be heated air or can be a carrier gas (eg. nitrogen, carbon dioxide, or the like) bearing a catalyst such as a vaporous tertiary amine catalyst. For practice of vapor permeation cure with the chamber of the present invention, a good discussion on various types of vapor permeation curable coating compositions can be found in commonly assigned U.S. application Ser. No. 474,156, filed Mar. 10, 1983, the disclosure of which is expressly incorporated herein by reference. Such copending application describes and references a variety of polyols, multi-isocyanates, and optional solvents for formulating vapor permeation curable coatings.

Additional applications of the curing chamber include its use as a heating oven where it substitutes the familiar air curtain for pressure balancing. Traditional air curtains result in higher losses due to increased turbulence at the inlet and outlet. These convective heat losses are minimal in the novel curing chamber which only suffers from radiant heat losses (which are independent of design). A further application could be the gassing of agricultural products for insecticide or pesticide treatment. The ability of the novel chamber design to handle large parts and confine the gas flow environment effectively permits such diverse uses of the chamber. Another application could be gas or vapor adsorption on a surface of a part for surface treatment, eg. corrosion resistance or the like. For these and other uses of the chamber of the present invention, reference to the particular art of interest is made.

The following examples show operation of the chamber in the drawings in accordance with the precepts of the present invention. Such examples are illustrative of the chamber of the present invention and should not be construed as limitative.

EXAMPLES

EXAMPLE 1

The chamber in the drawings was subjected to evaluation for containment of vaporous TEA carried in nitrogen in central flow zone 14. The TEA/nitrogen stream was admitted into zone 14 through inlets 62 and 64, and withdrawn from zone 14 through outlets 66 and 68. The withdrawn stream then was recycled to inlets 62 and 64 (via means not shown in the drawings) and additional TEA (make-up TEA) was added to such recycle as necessary to maintain the desired TEA concentration in central zone 14. Flow rates in the individual hoods were monitored by visual sightings from pilot tubes. These measurements were only used to equilibrate the hoods for each zone. The total flow rate of all exhaust hoods combined independently from zone 10 and from zone 12 was accurately measured using an orifice flow meter with temperature and pressure correction and these measurements used to reliably calculate TEA loss rates. Note that all flow rates, l/min, are based on conditions at 15.6° C. and 1 atmosphere.

The TEA nitrogen stream was generated by an amine generator composed of a 190 L (50 gal) tank containing 114 L (30 gal.) of liquid TEA. The tank was fitted with a 7.62 cm (3 in.) diameter packed (152.5 cm of Koch Sulzer dense packing) column fitted with a spray nozzle and conventional mist eliminator. Liquid TEA was pumped at a rate of about 3.8 L/min. to the spray nozzle which sprayed the liquid TEA down onto the packing. Nitrogen was bubbled through the column to greater than 95% saturation and sent directly to the recirculation loop of zone 14.

After the desired TEA concentration of 0.45 vol-% in central zone 14 was stabilized, make-up TEA in the recycle was terminated and the decline in TEA concentration in zone 14 was recorded. These measurements enabled calculation of TEA loss from central zone 14 in accordance with the following formula:

$$q=v/t[ln\ (c-a)-ln\ (y_t-a)] \quad (I)$$

where, q=rate of gas replacement in zone 14 (l/min)

v=total volume of zone 14 including hoods and circulation loop (l)

t=time (min)

c=initial TEA concentration (vol-%)

$y_t$=TEA concentration at time t (vol-%)

a=TEA concentration of infiltered air, which is 0 in this case (vol-%)

In this example, the TEA concentration in central zone 14 was established and maintained at 0.45 vol-%. The flow rates in all hoods were measured and recorded. Note that the flow rates in overhead hoods 38 and 40, and 54 and 56; and underneath hoods 30 and 32, and 46 and 48 were combined for measurement.

| | Hood No. | Flow (l/min) |
|---|---|---|
| Zone 10 | | |
| | 30/32 | 152.34 |
| | 34 | 157.44 |
| | 36 | 150.36 |
| | 38/40 | 160.27 |
| | 42 | 162.25 |
| | 44 | 154.32 |
| Zone 12 | | |
| | 46/48 | 157.44 |
| | 50 | 152.34 |
| | 52 | 153.47 |
| | 54/56 | 147.24 |
| | 58 | 155.46 |
| | 60 | 149.23 |
| Zone 14 | | |
| | 62 | 224.26 |
| | 64 | 224.26 |
| | 66 | 189.43 |
| | 68 | 209.26 |

The above-tabulated data shows that the flow rates in zones 10 and 12 were within about 2.4% of each other, indicating that the pressure in each zone was substantially the same. This means that no loss of TEA from the chamber could occur, but only loss of TEA from zone 14 into the exhausts of zones 10 and 12. In order to calculate such TEA losses, the make-up TEA supply in the recirculation line was terminated and the rate of loss of TEA concentration recorded. This data along with q from equation (I) is set forth below:

| Time (sec) | TEA Concentration (vol %) | q (l/min) |
|---|---|---|
| 0 | 0.45 | — |
| 15 | 0.30 | 165.65 |
| 30 | 0.21 | 155.74 |
| 44 | 0.14 | 106.20 |
| 55 | 0.10 | 167.63 |
| 66 | 0.07 | 173.01 |
| 86 | 0.06 | 143.56 |
| 100 | 0.03 | 166.22 |
| 117 | 0.02 | 163.10 |

q (mean) = 155.17 l/min.
q (medium) = 164.52 l/min

Based on the above-tabulated data, the TEA was being depleted or lost from zone 14 at the rate of only about 0.190 kg/hr (0.418 lb/hr).

EXAMPLE 2

In this example, the TEA concentration in zone 14 was maintained at about 0.38 wt-%. The total exhaust flow rate from zone 10 (all hoods) was about 918.42 l/min. and from zone 12 (all hoods) about 919.83 l/min. The exhaust flow from zone 10 was found to contain 0.04 vol-% TEA and from zone 12 the TEA concentration was 0.02 vol-%. The TEA loss from zone 14, then, was at a rate of about 0.140 kg/hr.

The TEA concentration in the recirculation lines to zone 14 then was adjusted at 0.22 vol-%. The total flow from inlet zone 10 then was 855.99 l/min. and from outlet zone 12 it was 919.83 l/min. The TEA concentration in central zone 14 then was recorded at various points in the zone as set forth below:

| Location in Zone 14 (inches up from Bottom) | TEA Concentration (vol %) Port 90a | Port 90e | Port 90i |
|---|---|---|---|
| 10 | 0.22 | 0.25 | 0.10 |
| 8 | 0.20 | 0.21 | 0.09 |
| 6 | 0.21 | 0.19 | 0.09 |
| 4 | 0.16 | 0.17 | 0.05 |
| 2 | 0.21 | 0.12 | 0.06 |
| 1 | 0.20 | 0.15 | 0.05 |

The above-tabulated data demonstrates the substantial uniformity of TEA concentration vertically in zone 14 (concentration data is ±0.02% considering the accuracy of the TEA analyzer). The discrepancy in TEA concentration between Ports **90*a* and 90*i* is caused by the greater pressure in outlet zone 12 compared to the pressure in zone 10, which pressure differential causes the TEA concentration in zone 14 to shift in bulk towards inlet zone 10**. The need to balance the pressures in the inlet and outlet zones, thus, is underscored.

EXAMPLE 3

In this example, the flow rates in the hoods were recorded as follows:

| | Hood No. | Flow (l/min) |
|---|---|---|
| Zone 10 | | |
| | 30/32 | 73.05 |
| | 34 | 68.24 |
| | 36 | 73.05 |
| | 38/40 | 73.05 |
| | 42 | 73.05 |
| | 44 | 73.05 |
| Zone 12 | | |
| | 46/48 | 73.06 |

-continued

| | Hood No. | Flow (l/min) |
|---|---|---|
| | 50 | 60.88 |
| | 52 | 73.06 |
| | 54/56 | 56.07 |
| | 58 | 60.80 |
| | 60 | 60.88 |
| Zone 14 | | |
| | 62 | 248.33 |
| | 64 | 224.26 |
| | 66 | 199.35 |
| | 68 | 209.26 |

The above-tabulated data shows that the inlet and outlet zones were functioning properly. The following measurements on the total flow rates from zones 10 and 12, and their TEA concentrations, are set forth below:

| | vol % TEA | Flow (l/min) |
|---|---|---|
| Inlet Zone 10 | 0.03 | 511.46 |
| Outlet Zone 12 | 0.04 | 510.61 |
| Central Zone 14 | 0.52 | 368.11 (Recycle) |

Based upon the above-tabulated data, the TEA loss in the exhaust hoods is about 0.092 kg/hr. Again, the advantages of the chamber design and operation are demonstrated.

EXAMPLE 4

In this example, TEA loss from central zone 14 was determined by three different methods described below.

| | vol % TEA | Flow (l/min) |
|---|---|---|
| Inlet Zone 10 | 0.01 | 287.45 |
| Outlet Zone 12 | 0.07 | 288.01 |
| Recycle Make-up | 7.73 | 4.43 |

The TEA concentration in central zone 14 was maintained at about 0.42 vol-%. After steady-state was reached, the recycle make-up TEA was terminated and the concentration in central zone 14 recorded as a function of time from termination. In accordance with equation (I) q was calculated.

| Time (sec) | TEA Concentration (vol %) | q (l/min) |
|---|---|---|
| 34 | 0.31 | 92.03 |
| 59 | 0.27 | 91.18 |
| 94 | 0.17 | 87.50 |
| 139 | 0.07 | 98.26 |

-continued

| Time (sec) | TEA Concentration (vol %) | q (l/min) |
|---|---|---|
| 169 | 0.05 | 93.17 |

q (avg) = 92.31 l/min.

The TEA loss methods used were based on (A) the flow rates and TEA concentrations from zones 10 and 12; (B) the make-up TEA supply; and (C) the time/concentration profile with no make-up TEA. These three methods yield the following TEA loss rates.

(A) 0.059 kg/hr.
(B) 0.087 kg/hr.
(C) 0.099 kg/hr.

These loss rates are within experimental error and confirm the very low loss rates of TEA which the inventive chamber experiences.

EXAMPLE 5

The TEA concentration in central zone 14 was stabilized at about 0.46 vol-%. Data was gathered to enable calculation of TEA loss rates based upon (A) TEA contained in the exhaust of the inlet and outlet zones, and (B) by the consumption of make-up TEA to the recycle to central zone 14.

| | vol % TEA | Flow (l/min) |
|---|---|---|
| Inlet Zone 10 | 0.03 | 297.08 |
| Outlet Zone 12 | 0.04 | 297.64 |
| Recycle Make-up | 6.45 | 4.37 |

Based upon the above-tabulated data, the following TEA loss rates were determined.

(A) 0.053 kg/hr.
(B) 0.072 kg/hr.

The TEA concentration profile in central zone 14 is set forth below.

| Location in Zone 14 (inches up from Bottom) | TEA Concentration (vol %) at Port | | | | | | | | |
|---|---|---|---|---|---|---|---|---|---|
| | 90a | 90b | 90c | 90d | 90e | 90f | 90g | 90h | 90i |
| 11 | 0.05 | 0.30 | 0.52 | — | 0.53 | — | — | — | 0.49 |
| 10 | 0.04 | 0.21 | 0.47 | 0.55 | 0.54 | 0.58 | 0.56 | 0.59 | 0.47 |
| 8 | 0.10 | 0.19 | 0.48 | — | 0.50 | — | — | 0.57 | 0.45 |
| 6 | 0.22 | 0.21 | 0.47 | 0.57 | 0.49 | 0.58 | 0.59 | 0.55 | 0.47 |
| 4 | 0.47 | 0.40 | 0.45 | — | 0.50 | — | — | 0.54 | 0.48 |
| 2 | 0.47 | 0.45 | — | — | 0.49 | — | — | — | 0.48 |
| 1 | 0.47 | 0.50 | 0.47 | 0.55 | 0.46 | 0.55 | 0.55 | 0.54 | 0.43 |

The TEA concentration in outlet zone 10 at the boundary (Port 72) was 0.03% and in outlet zone 12 as the boundary (Port 74) it was 0.17%. Thus, the data is indicative of a substantially balanced chamber where the pressures in the inlet and outlet zones were substantially equal. This balance resulted in very low TEA losses from central zone 14.

EXAMPLE 6

In this example, the TEA concentration in central zone 14 was maintained at 0.50±0.02 vol-%. The following data was collected.

| | vol % TEA | Flow (l/min) |
|---|---|---|
| Inlet Zone 10 | 0.03 | 297.36 |

-continued

| | vol % TEA | Flow (l/min) |
|---|---|---|
| Outlet Zone 12 | 0.05 | 297.36 |

This data translates in a TEA loss rate of 0.061 kg/hr. Again, the design of the chamber is proven.

EXAMPLE 7

TEA consumption (loss) can be minimized by minimizing the relative flow velocity between the gases in the inlet zone and gas flow zone at their boundary, and between the gases in the outlet zone and gas flow zone at their boundary. Since the flow in central zone 14 is transverse, it would seem advisable to establish cocurrent transverse flow in the inlet zone and in the outlet zone at their boundary with central flow zone 14. In order to accomplish this parallel flow regime, hoods 44 and 60 were disconnected and permitted to remain open to the room housing the chamber. Also, the outer 8 vanes (vanes 84*a*–84*h* in hood 44 and vanes 89*a*–89*h* in hood 60) in hoods 44 and 60 were closed fully leaving the inner 4 vanes open. Hoods 42 and 58 were fully closed. Also, overhead hoods 38, 40, 54, and 56, and underneath hoods 30, 32, 46, and 48 were fully closed in order to enhance transverse flow in outlet zone 10 and outlet zone 12. TEA make-up flow was varied in order to establish and maintain a desired steady-state TEA level in central zone 14.

For a TEA level of 0.80 vol-% in chamber 14, the following hood flow rates based on pitot tube measurements were recorded.

| | Hood No. | Flow (l/min) |
|---|---|---|
| Inlet Zone 10 | | |
| | 34 | 246.38 |
| | 36 | 246.38 |
| Outlet Zone 12 | | |
| | 50 | 243.55 |
| | 52 | 243.55 |
| Central Zone 14 | | |
| | 62 | 243.55 |
| | 64 | 243.55 |
| | 66 | 237.89 |
| | 68 | 237.89 |

The flow rate differentials between central flow zone 14 and the transverse air flow at the boundary in inlet zone 10 and outlet zone 12 have been reduced dramatically compared to the previous examples. The total exhaust from inlet zone 10 was measured by an orifice meter at 312.37 l/min; and from outlet zone 12 it was measured at 312.94 l/min.

The make-up TEA supply was measured at 8.80±0.15 vol-%. At various TEA make-up supply rates, various TEA loss rates and TEA zone 14 concentrations were achieved as follows:

| Make-up Flow (l/min) | TEA in Zone 14 (vol %) | TEA Loss (kg/min) |
|---|---|---|
| 3.47 | 0.80 | 0.078 |
| 2.76 | 0.60 | 0.059 |
| 2.14 | 0.46 | 0.048 |

All of the TEA loss rates recorded above are less than the TEA rates experienced with all exhaust hoods operating at equivalent TEA concentrations in central zone 14.

Another set of flow conditions was established as follows:

TEA in zone 14=0.54 vol-%
Zone 10 exhaust=312.37 l/min.
Zone 12 exhaust=312.94 l/min.
Make-up TEA concentration=8.8±0.15 vol-%
Make-up TEA flow=3.49 l/min.
Make-up TEA consumption=0.079 kg/hr.

The above conditions were established with all vanes in hoods 44 and 60 open. When 8 vanes were closed in both hood 44 and in hood 60, the TEA concentration in central zone 14 dropped to 0.51 vol-%.

At the stabilized TEA concentration in central zone 14 of about 0.52±0.03 vol-%, the following TEA concentration profile was determined.

| Location in Zone 14 (inches up from bottom) | TEA Concentration (vol %) at Port | | | | | | |
|---|---|---|---|---|---|---|---|
| | 72 | 90a | 90c | 90e | 90g | 90i | 74 |
| 10 | .44 | .54 | .53 | .44 | .54 | .43 | .26 |
| 6 | .30 | .48 | .49 | .37 | .42 | .30 | .05 |
| 2 | .30 | .42 | .37 | .34 | .48 | .23 | .03 |

These results show the fairly uniform TEA concentration in central zone 14. Also, a shift of the TEA concentration profile towards zone 10 was observed.

EXAMPLE 8

In this series of tests, the effect of objects passing through the curing chamber was evaluated. Styrofoam rectangular blocks measuring 6.35 cm×5.08 cm×20.32 cm (2.5 in.×2 in.×8 in.) were hung from overhead conveyor 22 at various spacings and the conveyor set at different line speeds. The change in TEA concentration in central zone 14 then was recorded. Note that the results below do not account for TEA adsorption by the styrofoam blocks. The procedure of Example 1 was followed.

The TEA concentration was 0.54 vol-% in central zone 14 and the conveyor was set at a rate of 0.61 m/min. The following results were recorded:

(A) 7 blocks at 30.48 cm spacing: no TEA concentration change.

(B) 9 blocks in zone 14 at 7.62 cm spacing and 2 blocks in zone 10 and 30.48 cm spacing: No TEA concentration change (C) 9 blocks in zone 12 at 7.62 cm spacing, 4 blocks in each zone 10 and 14 equally spaced: TEA concentration dropped to 0.49 vol-%.

(D) 9 blocks in zone 10 at 7.62 cm spacing, 4 blocks in each zone 12 and 14 at 30.48 cm spacing: TEA concentration drops to 0.49 vol-%.

The above tests were repeated and the same results recorded.

The TEA concentration in zone 14 then was stabilized at 0.52 vol-% and the conveyor set at a rate of 1.83 m/min. With blocks spaced apart at either 7.62 cm or 30.48 cm in any zone, the TEA concentration dropped to 0.46 vol-%. No appreciable TEA difference between the different spacings was noted.

The TEA concentration in zone 14 next was stabilized at 0.47 vol-% with the conveyor set at 1.83 m/min. Blocks randomly spaced apart at 7.62, 15.24, and 30.48 cm through the chamber caused the TEA concentration to drop to about 0.37–0.42 vol-%.

The results show that some TEA loss can be expected by passing large objects through the chamber. Still, such TEA losses were minimal.

I claim:

1. A chamber which defines a constant gas environment for passing moving objects therethrough and which is in open communication with the outside, which comprises:

a housing which confines an inlet zone, an outlet zone, and an interior central gas zone interposed therebetween; said central gas zone being in open communication with both said inlet zone and said outlet zone; and said inlet and outlet zones both being in open communication with the environment outside of said chamber;

said inlet and outlet zones each being connected to a source of suction to create a pressure within each said zone which is less than the ambient pressure outside of said chamber, said sources of suction also being adjusted and maintained such that the pressure within each said inlet and outlet zones are substantially the same;

said central gas zone having gas flow inlet means and oppositely disposed outlet means, and flow control means which are maintained to establish ostensibly transverse laminar gas flow between said gas flow inlet and oppositely disposed outlet means;

the interface between said central gas zone and each of said inlet and outlet zones adapted to be held under conditions substantially preclusive of turbulent flow conditions.

2. The chamber of claim 1 which further contains a conveyor disposed throughout the length of said chamber.

3. The chamber of claim 1 wherein said gas inlet flow means and oppositely disposed outlet means in said central gas zone provide horizontal gas flow therebetween.

4. The chamber of claim 1 wherein said gas flow inlet means and oppositely disposed outlet means in said central gas zone are disposed to provide vertical gas flow therebetween.

5. The chamber of claim 1 wherein both said inlet zone and said outlet zone at their boundaries adjacent said central gas zone contain gas flow inlet means and oppositely disposed outlet means and flow control means which are adapted to be maintained to establish ostensibly transverse laminar gas flow therebetween at a velocity which is substantially equal to the velocity of gas flow between the gas flow inlet means and oppositely disposed outlet means of said central gas zone.

6. The chamber of claim 1 wherein the gas flow withdrawn from said central zone through said outlet means is recycled to said gas flow inlet means of said central zone.

7. The chamber of claim 1 which is adapted for said constant gas flow for said central gas flow zone to comprise a vaporous tertiary amine carried by an inert carrier gas.

8. A method for maintaining a constant gas environment in a chamber wherein moving objects can be passed through said environment, said chamber housing said constant gas flow environment being in open communication with the ambient outside, comprising:

admitting said gas flow into a central interior gas flow zone through a gas flow inlet means and withdrawing said gas flow from said central gas flow zone by outlet means which is oppositely disposed from said inlet means, said central gas flow zone further containing flow control means which are maintained to establish ostensibly transverse laminar gas flow between said inlet means and said outlet means;

applying suction to an inlet zone and to an outlet zone which zones are connected to said central gas zone and are in open communication therewith, said inlet and outlet zones also being in open communication with the ambient atmosphere outside of said chamber, said source of suction being applied to said inlet zone and to said outlet zone adequately to create substantially equal pressures in said inlet and outlet zones, the pressures within each of said inlet and outlet zones being less than ambient atmospheric pressure outside of said chamber;

maintaining gas flow conditions at the interface between said interior gas zone and each of said inlet and outlet zones to be substantially preclusive of turbulent flow conditions.

9. The method of claim 8 wherein an object is passed through said chamber by means of a conveyor which passes through said chamber.

10. The method of claim 9 wherein the gas admitted into said central gas zone comprises a vaporous tertiary amine carried by an inert gas.

11. The method of claim 10 wherein an object coated with a vaporous amine curable coating composition is passed through said chamber by means of a conveyor which passes through said chamber and is cured by exposure to said vaporous tertiary amine.

12. The method of claim 8 wherein said gas flow withdrawn from said central gas zone through said outlet means is recycled to said zone.

13. The method of claim 8 wherein the gas flow in said inlet and outlet zones at their boundary with said central gas zone is maintained in cocurrent flow with the transverse laminar gas flow through said central gas zone, the relative velocities therebetween being maintained at a minimum.

* * * * *